US009013106B2

(12) United States Patent
Zhang et al.

(10) Patent No.: US 9,013,106 B2
(45) Date of Patent: Apr. 21, 2015

(54) LAMP BALLAST HAVING FILAMENT HEATING APPARATUS FOR GAS DISCHARGE LAMP

(75) Inventors: Weiqiang Zhang, Shanghai (CN); Qi Zhang, Shanghai (CN); Yan Zhong, Shanghai (CN); Ching-Ho Chou, Taoyuan Hsien (TW); Jianping Ying, Shanghai (CN)

(73) Assignees: Delta Electronics (Shanghai) Co., Ltd., Shanghai (CN); Delta Electronics, Inc., Taoyuan Hsien (TW)

( * ) Notice: Subject to any disclaimer, the term of this patent is extended or adjusted under 35 U.S.C. 154(b) by 714 days.

(21) Appl. No.: 13/242,170

(22) Filed: Sep. 23, 2011

(65) Prior Publication Data

US 2012/0313527 A1 Dec. 13, 2012

(30) Foreign Application Priority Data

Jun. 13, 2011 (CN) ..... 2011 1 0158052

(51) Int. Cl.
*H01J 13/32* (2006.01)
*H05B 41/295* (2006.01)

(52) U.S. Cl.
CPC ..... *H05B 41/295* (2013.01)

(58) Field of Classification Search
USPC ..... 315/247, 224, 245, 185 S, 209 R, 315/274–280, 291, 307–312, 94–99, 101, 315/106, 107, 46–54, 112–118
See application file for complete search history.

(56) References Cited

U.S. PATENT DOCUMENTS

| | | | | |
|---|---|---|---|---|
| 7,443,113 | B2 * | 10/2008 | Crouse et al. | 315/308 |
| 2010/0194302 | A1 * | 8/2010 | Nakada et al. | 315/224 |
| 2011/0095693 | A1 | 4/2011 | Nerone et al. | |

FOREIGN PATENT DOCUMENTS

| | | |
|---|---|---|
| CN | 101827477 | 9/2010 |
| CN | 101835322 | 9/2010 |
| TW | I240598 | 9/2005 |
| TW | 200908799 | 2/2009 |
| TW | 201110824 | 3/2011 |

* cited by examiner

*Primary Examiner* — Tuyet Thi Vo
(74) *Attorney, Agent, or Firm* — Kirton McConkie; Evan R. Witt

(57) ABSTRACT

Provided is a lamp ballast having a filament heating apparatus for gas discharge lamp, including a PFC converter for receiving an AC input voltage and converting the AC input voltage into a DC bus voltage; an inverter connected to an output end of the PFC converter for converting the DC bus voltage into an AC output voltage for driving gas discharge lamps; and a filament heating apparatus connected to the output end of the PFC converter. The filament heating apparatus includes an auxiliary heating circuit for converting the DC bus voltage into a heating power for pre-heating the filaments of the gas discharge lamps; and a control circuit connected to the inverter and the auxiliary heating circuit for generating an auxiliary voltage according to the heating power to activate the PFC converter. After the auxiliary heating circuit has been operating for a predetermined period of time, the auxiliary heating circuit is turned off first and then the inverter is turned on; or otherwise the inverter is turned on first and then the auxiliary heating circuit is turned off.

12 Claims, 12 Drawing Sheets

LAMP BALLAST HAVING FILAMENT HEATING APPARATUS FOR GAS DISCHARGE LAMP

FIELD OF THE INVENTION

The invention relates to a lamp ballast for igniting and operating gas discharge lamps, and more particularly to a lamp ballast having a filament heating apparatus for gas discharge lamps.

BACKGROUND OF THE INVENTION

FIG. 1 is a systematic block diagram of a lamp ballast for use with gas discharge lamps according to the prior art. As shown in FIG. 1, the lamp ballast for use with gas discharge lamps includes a power factor correction converter (PFC converter) 102 and an inverter 104 for igniting and operating gas discharge lamps LP1-LP2. The power factor correction converter 102 is typically an active boost converter and the inverter 104 is typically a self-oscillating parallel resonant circuit. The capacitors Cb1 and Cb2 are connected in series with gas discharge lamps LP1-LP2, respectively, for balancing the lamp currents flowing through the gas discharge lamps LP1-LP2. The conventional lamp ballast can be classified into two categories according to the ignition method of the gas discharge lamp. The first category is called pre-heating lamp ballast, and the second category is called instant start lamp ballast. For a pre-heating lamp ballast, a considerably high voltage is needed to be applied to both sides of the gas discharge lamp to pre-heat the filament of the lamp before the gas discharge lamp is ignited. The heating power for the filaments of the gas discharge lamp is generally provided by the inverter 104. The pre-heating mechanism for the filaments of the gas discharge lamps is achieved by coupling a number of heating windings (not shown) to the transformer of the inverter 104 (not shown). After the inverter 104 is started, the heating windings will generate heat by way of electromagnetic effect in order to pre-heat the filaments of the gas discharge lamps LP1-LP2. Nevertheless, before the filaments of the gas discharge lamps LP1-LP2 are fully heated, an output voltage is established across the gas discharge lamps LP1-LP2. This output voltage would result in a glow discharge current. Another drawback of the conventional pre-heating mechanism for gas discharge lamp is that the heating power is hard to be removed after the gas discharge lamp is operating in a stable state. This would increase the power loss of the lamp ballast.

Therefore, it is preferable to provide a filament heating apparatus for pre-heating the filaments of gas discharge lamps in order to improve the efficiency of gas discharge lamps.

SUMMARY OF THE INVENTION

A primary object of the invention is to provide a lamp ballast having a filament heating apparatus for heating the filaments of gas discharge lamps. The inventive lamp ballast includes a power factor correction converter and an inverter as well as a filament heating apparatus. The filament heating apparatus is connected to the output end of the power factor correction converter for pre-heating the filaments of gas discharge lamps for a predetermined period of time and then starting the inverter to ignite and operate the gas discharge lamps.

According to a broad aspect of the invention, the invention provides a lamp ballast including a power factor correction converter for receiving an AC input voltage and converting the AC input voltage into a DC bus voltage; an inverter connected to an output end of the power factor correction converter for converting the DC bus voltage into an AC output voltage for powering a plurality of gas discharge lamps; and a filament heating apparatus for gas discharge lamps which is connected to an output end of the power factor correction converter. The filament heating apparatus includes an auxiliary heating circuit connected to an output end of the power factor correction converter for converting the DC bus voltage of the power factor correction converter into a heating power for pre-heating the gas discharge lamps, and a control circuit connected to the inverter and the auxiliary heating circuit for generating an auxiliary voltage to start the power factor correction converter by the heating power. After the auxiliary heating circuit has operated for a predetermined period of time, the control circuit turns off the auxiliary heating circuit first and then starts the inverter, or otherwise starts the inverter first and then turns off the auxiliary heating circuit.

Now the foregoing and other features and advantages of the invention will be best understood through the following descriptions with reference to the accompanying drawings, wherein:

DESCRIPTION OF THE PREFERRED EMBODIMENT

Several exemplary embodiments embodying the features and advantages of the invention will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as a confinement for the invention.

Figure 1:
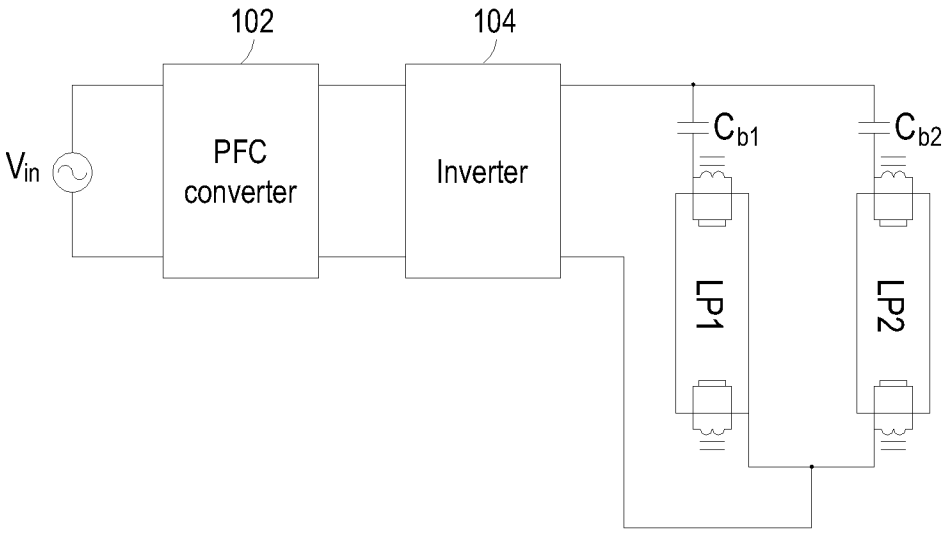
Fig. 1 (PRIOR ART)
FIG. 1 is a systematic block diagram of a lamp ballast for use with gas discharge lamps according to the prior art.
Figure 2:
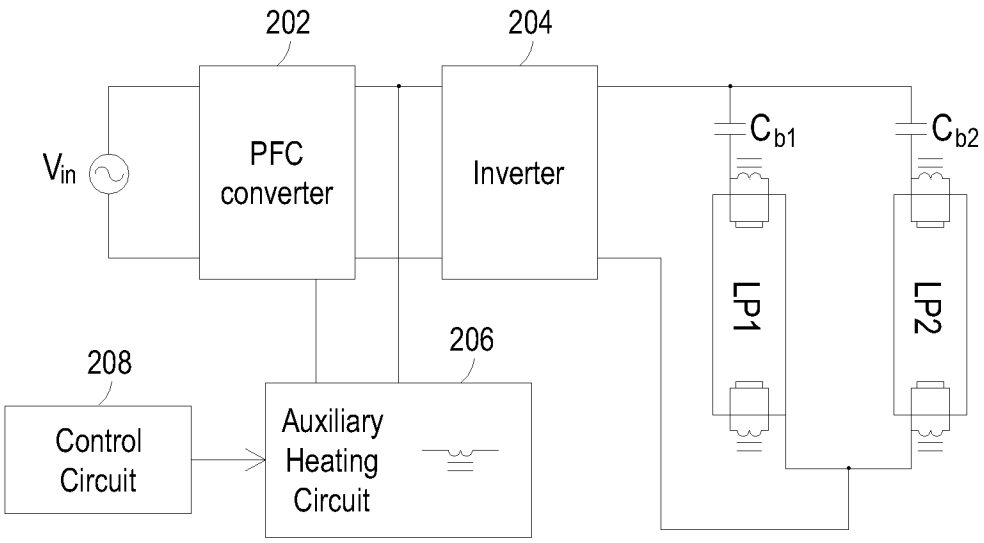
FIG. 2 is a circuit block diagram showing a lamp ballast having a filament heating apparatus for gas discharge lamps according to the invention.

FIG. 2 is a circuit block diagram showing a lamp ballast having a filament heating apparatus for gas discharge lamps according to the invention. It should be noted that the same reference numerals are used to label similar circuit elements throughout the specification. As shown in FIG. 2, the lamp ballast includes a power factor correction converter 202 for receiving an AC input voltage Vin and converting the AC input voltage Vin into a DC voltage, in which the harmonics and ripple noises of the input current of the AC input voltage Vin are filtered out by the power factor correction converter 202. The lamp ballast further includes an inverter 204 connected to the output end of the power factor correction converter 202 for converting the DC voltage outputted by the power factor correction converter 202 into an AC voltage for driving a plurality of gas discharge lamps LP1-LP2. In this embodiment, the number of the gas discharge lamps may be one, namely, the gas discharge lamp LP1 may be the only one lamp to be driven by the lamp ballast. The gas discharge lamps LP1-LP2 are connected in parallel with each other and each lamp is connected in series with a capacitor (Cb1 or Cb2). The capacitor Cb1 or Cb2 is used to balance the lamp currents flowing through the gas discharge lamps LP1-LP2. The lamp ballast further includes a filament heating apparatus consisted of an auxiliary heating circuit 206 and a control circuit 208. The auxiliary heating circuit 206 is connected to the output end of the power factor correction converter 202 for providing the heating power which is used to pre-heat the filaments of the gas discharge lamps LP1-LP2. The control circuit 208 is connected to the auxiliary heating circuit 206 and the inverter 204 for controlling the operating status of the auxiliary heating circuit 206 and the inverter 204 (ON or OFF). As to the internal circuitry of the lamp ballast, it will be described in the following.

Figure 3:
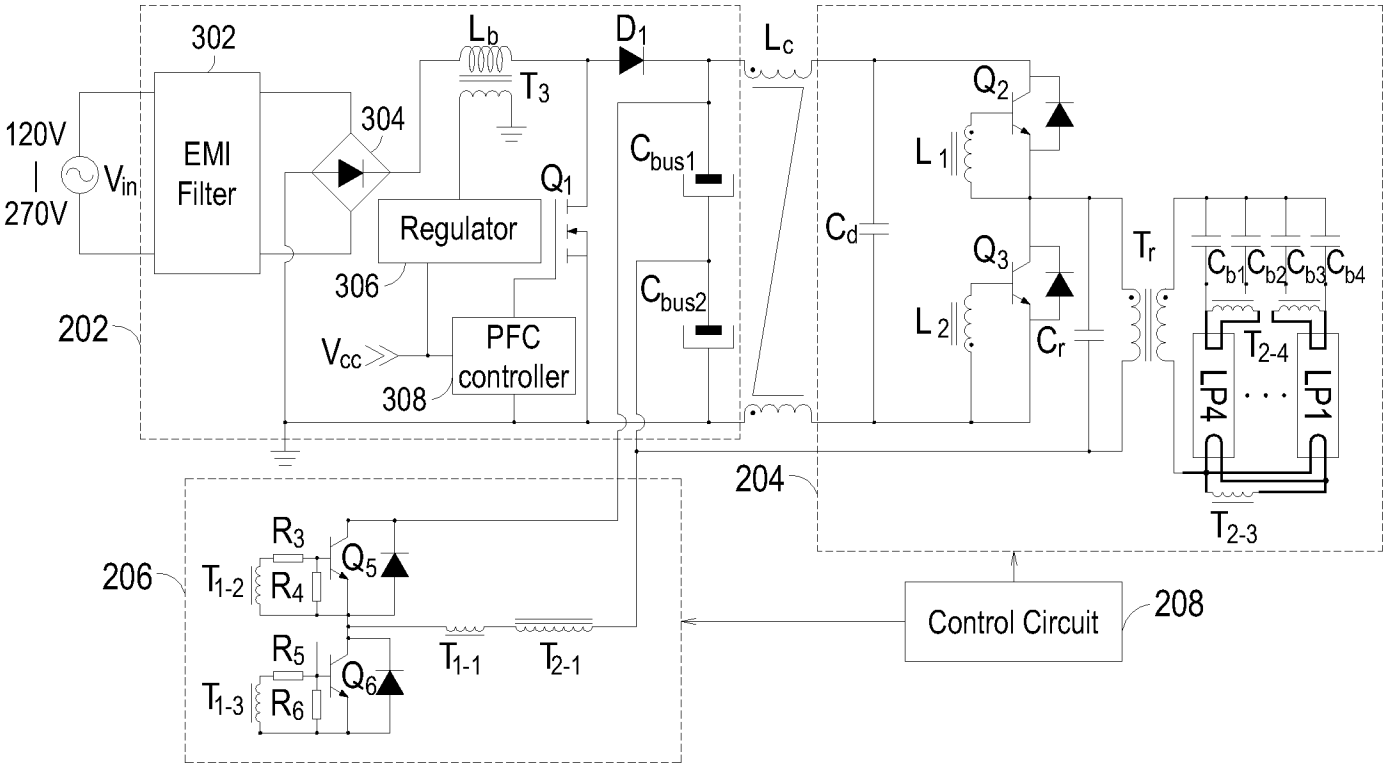
FIG. 3 is a circuit diagram showing a lamp ballast having a filament heating apparatus for gas discharge lamps according to the invention.

FIG. 3 is a circuit diagram showing a lamp ballast having a filament heating apparatus for gas discharge lamps according to the invention. As shown, the inventive lamp ballast includes a power factor correction converter 202 which is a boost converter and includes an electromagnetic interference filter (EMI filter) 302 connected to the AC input voltage Vin for removing the electromagnetic interference of the AC input voltage Vin. The root-mean-square value of the AC input voltage Vin is 120-270V. The power factor correction converter 202 also includes a bridge rectifier 304 connected in parallel with the EMI filter 302 for rectifying the AC input voltage Vin into a rectified DC voltage. The power factor correction converter 202 also includes a boost choke Lb connected to the output end of the bridge rectifier 304, and a switch Q1 having a first current terminal connected to the boost choke, a second current terminal connected to ground, and a control terminal connected to a power factor correction controller 308. The power factor correction controller 308 is powered by an auxiliary voltage Vcc and is used to control the switching of the switch Q1. The power factor correction converter 202 also includes a rectifying diode D1 connected to the boost choke Lb and the first current terminal of the switch Q1, and a pair of output capacitors Cbus1 and Cbus2 which are mounted on the voltage bus of the power factor correction converter 202 and are connected in series between the cathode of the rectifying diode D1 and the ground terminal. The boost choke Lb is set to retain the energy of the rectified DC voltage outputted by the bridge rectifier 304 when the switch Q1 is turned off, and release the energy stored therein when the switch Q1 is turned on. Thus, the level of the rectified DC voltage outputted by the bridge rectifier 304 is boosted. The rectifying diode D1 is used to rectify the voltage outputted by the boost choke Lb, and thereby generating a bus voltage Vbus on the output capacitors Cbus1 and Cbus2. A winding T3 is coupled to the boost choke Lb and is used to provide the energy of the auxiliary voltage Vcc through a regulator 306 after the power factor correction converter 202 is operating. Also, the winding T3 is also connected to the power factor correction controller 308 for detecting the current of the boost choke Lb.

The power factor correction converter 202 is connected to the inverter 204 through a common-mode choke Lc which is used to provide a current source. In this embodiment, the inverter 204 is a self-oscillating parallel resonant half-bridge converter consisted of switches Q2 and Q3 configured in a half-bridge manner. The switches Q2 and Q3 are set to turn on alternately to convert the stable DC bus voltage Vbus outputted by the power factor correction converter 202 into an AC output voltage for driving a plurality of gas discharge lamps LP1-LP4. The inverter 204 also includes a capacitor Cd connected in parallel with the common-mode choke Lc. The inverter 204 also includes a winding L1 connected between the control terminal of the switch Q2 and a current terminal of the switch Q2, and a winding L2 connected between the control terminal and a current terminal of the switch Q3. The inverter 204 also includes a resonant capacitor Cr connected between an intermediate node between the switch Q2 and the switch Q3 and the output voltage bus of the power factor correction converter 202. The inverter 204 also includes an isolated transformer Tr having a primary winding and at least one secondary winding and connected in parallel with the resonant capacitor Cr. The winding L1 is used to send a synchronous control signal to drive the switch Q2. The winding L2 is used to send a synchronous control signal to drive the switch Q3. The magnetizing inductance at the primary side of the isolated transformer Tr (not shown) and the resonant capacitor Cr forma parallel resonant circuit which is set to produce resonance to transmit the energy of the stable DC bus voltage Vbus outputted by the power factor correction converter 202 to the primary side of the isolated transformer Tr by way of resonance according to the switching of the switches Q2 and Q3. The energy of the primary side of the isolated transformer Tr is transmitted to the secondary side of the isolated transformer Tr according to the switching of the switches Q2 and Q3, thereby inducing an AC voltage at the secondary side of the isolated transformer Tr for driving the lamps LP1-LP4. The lamps LP1-LP4 are connected in parallel with each other and each lamp is connected to a capacitor (Cb1, Cb2, Cb3, or Cb4). The capacitors Cb1-Cb4 are used to balance the lamp currents flowing through the lamps LP1-LP4.

In this embodiment, the auxiliary heating circuit 206 includes a self-oscillating resonant half-bridge converter and a heating transformer T2-1 which is used to provide the heating power for pre-heating the filaments of the gas discharge lamps LP1-LP4. In alternative embodiments, the self-oscillating resonant half-bridge converter may be replaced by a full-bridge circuit. As shown in FIG. 3, the auxiliary heating circuit 206 includes a pair of switches Q5 and Q6 which may be implemented by bipolar junction transistors configured in half-bridge manner. The switches Q5 and Q6 may be configured as a flyback circuit or a forward circuit. The switches Q5 and Q6 are set to turn on alternately to convert the DC bus voltage Vbus outputted by the power factor correction converter 202 or a faction of the DC bus voltage Vbus into an AC output voltage. The auxiliary heating circuit 206 also includes a winding T1-1, a winding T1-2, a winding T1-3, voltage-dividing resistors R3, R4, voltage-dividing resistors R5, R6, and a heating transformer T2-1. The winding T1-2 is connected between the control terminal of the switch Q5 and a current terminal of the switch Q5 for sending a synchronous control signal to drive the switch Q5. The winding T1-3 is connected between the control terminal of the switch Q6 and a current terminal of the switch Q6 for sending a synchronous control signal to drive the switch Q6. The winding T1-1 is connected to an intermediate node between the switch Q5 and the switch Q6 and the primary side of the heating transformer T2-1, and shares a common magnetic core with the winding T1-2 and the winding T1-3. According to the switching of the switches Q5 and Q6, the energy of the DC bus voltage Vbus outputted by the power factor correction converter 202 is transmitted to the primary side of the heating transformer T2-1. Hence, the energy of the primary side of the heating transformer T2-1 can be transmitted to the windings T2-3 and T2-4 by way of electromagnetic induction, where the windings T2-3 and T2-4 and the heating transformer T2-1 share a common magnetic core. Thus, the filaments of the lamps LP1-LP4 are pre-heated. In this embodiment, the auxiliary heating circuit 206 may be a resonant circuit in which the switches thereof are driven by an independent controller instead of being driven in a self-oscillating manner. Also, in this embodiment, the auxiliary heating circuit 206 may be a PWM-based converter, such as a flyback converter or a forward converter.

Figure 4A:
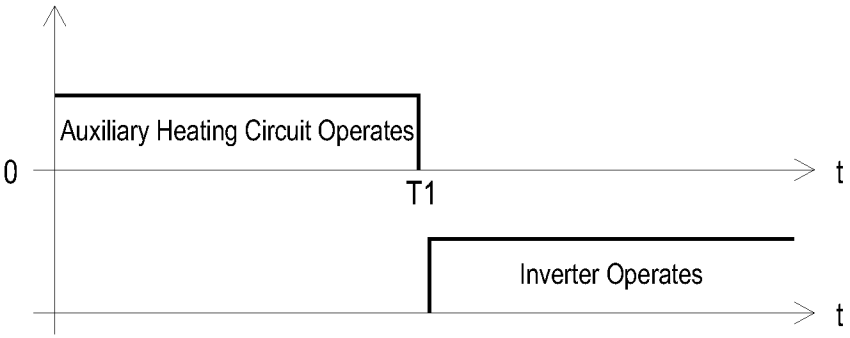
FIG. 4A shows a first sort of the operating sequence of the auxiliary heating circuit 206 and the inverter 204.
Figure 4B:
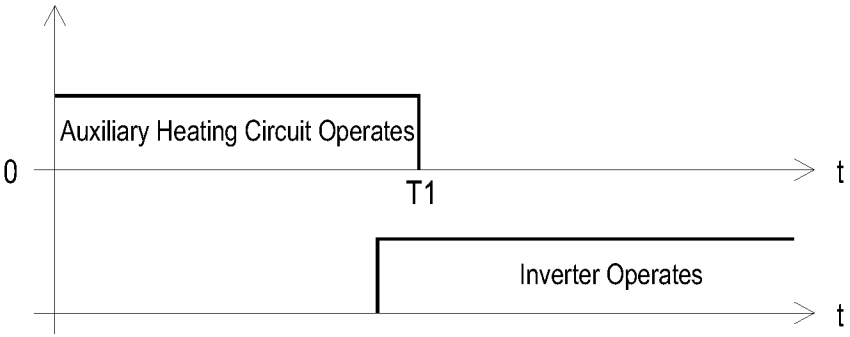
FIG. 4B shows a second sort of the operating sequence of the auxiliary heating circuit 206 and the inverter 204.

Also, the control circuit 208 is used to disable the auxiliary heating circuit 206 after the auxiliary heating circuit 206 has pre-heated the filaments for a predetermined period of time and then start the inverter 204 in order to ignite the lamps LP1-LP4. FIG. 4A shows a first sort of the operating sequence of the auxiliary heating circuit 206 and the inverter 204. As shown in FIG. 4A, the control circuit 208 is used to start the inverter 204 to ignite the lamps LP1-LP4 after the auxiliary heating circuit 206 has been disabled. FIG. 4B shows a second sort of the operating sequence of the auxiliary heating circuit 206 and the inverter 204. As shown in FIG. 4B, the control circuit 208 is used to start the inverter 204 to ignite the lamps LP1-LP4 first and disable the auxiliary heating circuit 206 after the inverter 204 has been operating for a predetermined period of time. Thus, the heating power for the filaments can be removed to increase the efficiency after the lamps LP1-LP4 are ignited.

Figure 5:
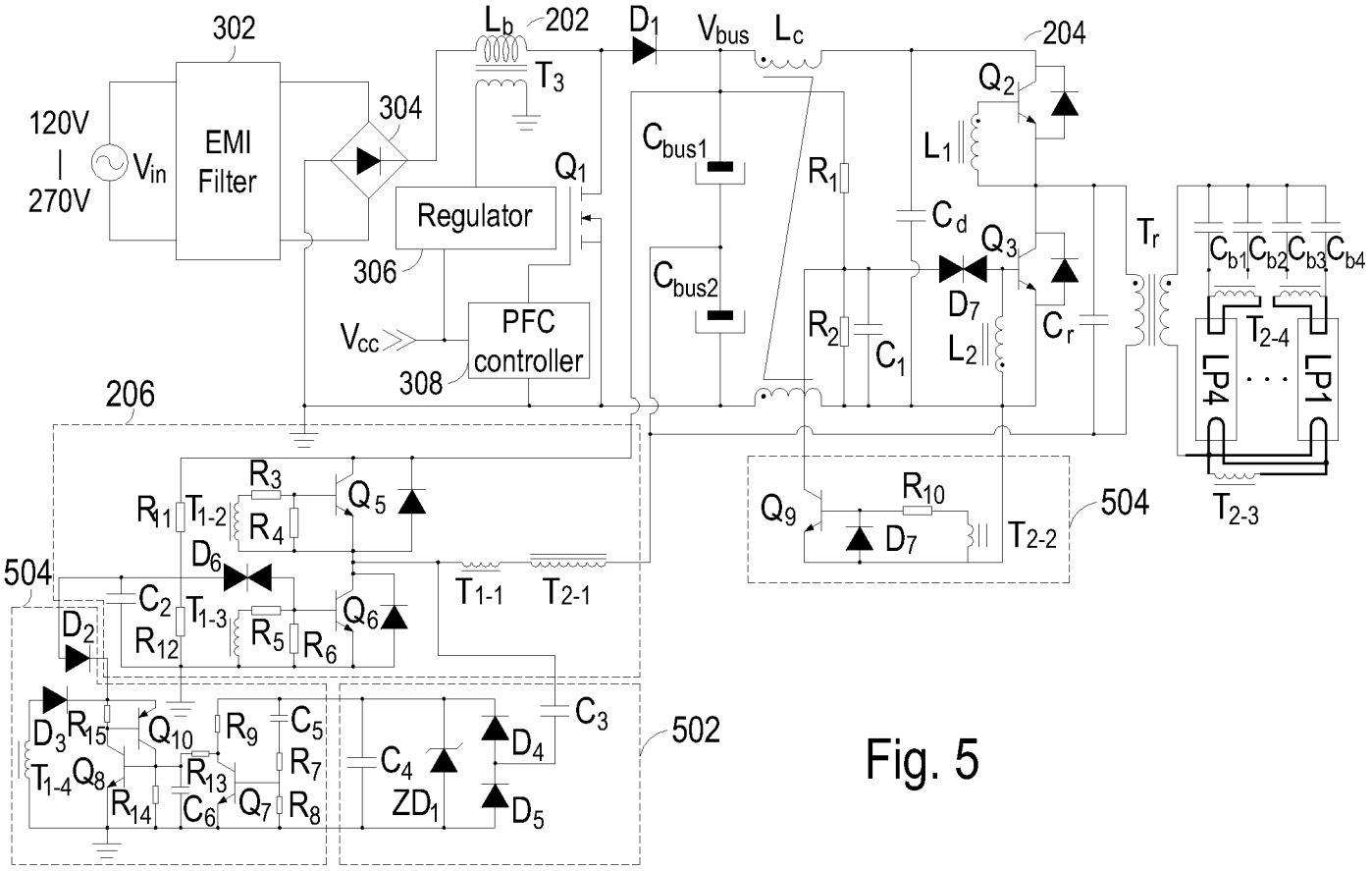
FIG. 5 is a circuit diagram showing a lamp ballast having a filament heating apparatus for gas discharge lamps according to a first embodiment of the invention, in which the detailed circuitry of the control circuit 208 is shown.

FIG. 5 is a circuit diagram showing a lamp ballast having a filament heating apparatus for gas discharge lamps according to a first embodiment of the invention, in which the detailed circuitry of the control circuit 208 is shown. As shown in FIG. 5, the auxiliary heating circuit 206 additionally includes a starter circuit compared to FIG. 3. The starter circuit shown in FIG. 5 includes voltage-dividing resistors R11, R12, a capacitor C2, and a diode device D6. The inverter 204 of FIG. 5 additionally includes a starter circuit which includes voltage-dividing resistors R1, R2, a capacitor C1, and a diode device D7. In FIG. 5, the control circuit 208 includes an auxiliary voltage generator 502 and a timing controller 504. The auxiliary voltage generator 502 includes capacitors C3, C4, rectifying diodes D4, D5, and a zener diode ZD1. The timing controller 504 includes a RC timer consisted of a capacitor C5 and resistors R7, R8 and R9, and a winding T1-4 and diodes D2, D3. The windings T1-1, the winding T1-2, the winding T1-3, and the winding T1-4 share a common magnetic core. The timing controller 504 also includes a winding T2-2, a resistor R10, a diode D7, and a control switch Q9. The heating transformer T2-1 and the winding T2-2 share a common magnetic core. The auxiliary voltage generator 502 is connected to the winding T1-1 and the timing controller 504 is connected to the auxiliary voltage generator 502, the starter circuit of the auxiliary heating circuit 206 (R11, R12, C2, D6), and the starter circuit of the inverter 204 (R1, R2, C1, D7). The timing controller 504 also includes resistors R13, R14, a capacitor C6, a control switch Q10, and a resistor R15. The control switches Q8, Q10, and the resistors R14, R15 function as a clamping circuit for preventing faulty operation or voltage jitter of the timing controller 504. The operation of the auxiliary heating circuit 206 and the control circuit 208 is described in the following.

When the lamp ballast is powered on, the auxiliary voltage Vcc has not been generated yet. Under this condition, the power factor correction converter 202 is not able to carry out switching operations. Hence, the output bus voltage Vbus of the power factor correction converter 202 is not stable and its voltage value is the product of the peak voltage of the AC input voltage Vin and a constant of 1.414. That is, as the power factor correction converter 202 is not started, the output bus voltage Vbus of the power factor correction converter 202 is about 170 Vdc (120V×1.414)–391 Vdc (277V×1.414). This unstable output bus voltage Vbus will be applied to the starter circuit (R11, R12, C2, D6) of the auxiliary heating circuit 206. The capacitor C2 is charged by the output bus voltage Vbus through the voltage-dividing resistors R11, R12. When the voltage of the capacitor C2 reaches the threshold level of the voltage-controlled device D6, the voltage-controlled device D6 is turned on to allow the windings T1-1, T1-2, and T1-3 to respectively induce a current thereupon. By the current variations of the windings T1-2 and T1-3, the windings T1-2 and T1-3 respectively generates a synchronous control signal to drive the switches Q5 and Q6 to carry out alternate switching operations. Therefore, the auxiliary heating circuit 206 is enabled and starts operating, such that the energy of the output bus voltage Vbus of the power factor correction converter 202 is transmitted to the primary side of the heating transformer T2-1 by the switching of the switches Q5 and Q6. The energy of the primary side of the heating transformer T2-1 is transmitted to the secondary side of the heating transformer T2-1 by way of electromagnetic induction, thereby pre-heating the filaments of the lamps LP1-LP4. In the meantime, as the winding T2-2 shares a common magnetic core with the heating transformer T2-1, a voltage is induced on the winding T2-2 as well. This induced voltage on the winding T2-2 turns on the control switch Q9 through the resistor R10. As the control switch Q9 is turned on, the capacitor C1 is prohibited from being charged by the output bus voltage Vbus through the voltage-dividing resistors R1, R2. Hence, the diode device D7 is not able to turn on to allow the windings L1 and L2 to respectively generate a synchronous control signal according to their current variations to drive the switches Q2 and Q3 to carry out alternate switching operations. Therefore, the inverter 204 is disabled and unable to start operating. Meanwhile, the AC voltage induced on the winding T1-1 is applied to the auxiliary voltage generator 502 and is converted by the charge pump consisted of the capacitor C3 and rectifying diodes D4 and D5 and filtered by the capacitor C4. In this manner, the auxiliary voltage Vcc is generated. The zener diode ZD1 is used to carry out voltage clamping operations to fix the voltage level of the auxiliary voltage Vcc. When the auxiliary voltage Vcc is generated, the power factor correction controller 308 is activated to start the switching operations of the power factor correction converter 202, thereby stabilizing the output bus voltage Vbus of the power factor correction converter 202. Under this condition, the auxiliary voltage Vcc charges the capacitor C5 and starts the timing operations of the timing controller 504 accordingly. When the capacitor C5 starts charging, the driving voltage applied to the control terminal of the control switch Q7 is high and exceeds the threshold voltage of the switch Q7. Thus, the control switch Q7 is turned on and the control switch Q8 is turned off accordingly. Under this condition, the control switch Q8 is OFF and would not affect the winding T1-4. When the voltage of the capacitor C5 is charged to a predetermined level after a predetermined period time, the driving voltage applied to the control terminal of the control switch Q7 will drop down to be lower than the threshold voltage of the control switch Q7, and thus the control switch Q7 is turned off. Therefore, the control switches Q8, Q10 are turned on. Under this condition, the winding T1-4 is short-circuited. Hence, the voltage signal of the winding T1-4 is dropped abruptly. As the winding T1-1, the winding T1-2, the winding T1-3, and the winding T1-4 share a common magnetic core, the voltage signal on the winding T1-1, the voltage signal on the winding T1-2, the voltage signal on the winding T1-3 will drop abruptly as well. Thus, the windings T1-2 and T1-3 are not able to send driving signals to drive the switches Q5 and Q6. Hence, the auxiliary heating circuit is not able to operate and is disabled. In this way, the heating transformer T2-1 is not able to generate the energy used to pre-heat the filaments of the lamps LP1-LP4. In the meantime, as the winding T2-1 and the winding T2-2 share a common magnetic core, the winding T2-2 do not have enough energy to turn on the control switch Q9 through the resistor R10. Thus, the control switch Q9 is turned off. As the control switch Q9 is turned off, the capacitor C1 is charged by the stable output bus voltage Vbus of the power factor correction converter 202 through the voltage-dividing resistors R1 and R2. When the voltage of the capacitor C1 reaches the threshold level of the diode device D7, the diode device D7 is turned on. The windings L1 and L2 respectively induce a current. By way of the current variations of the windings L1 and L2, the windings L1 and L2 respectively sends a synchronous control signal to drive the switches Q2 and Q3 to carry out alternate switching operations. Therefore, the inverter 204 is enabled and starts operating.

Figure 6:
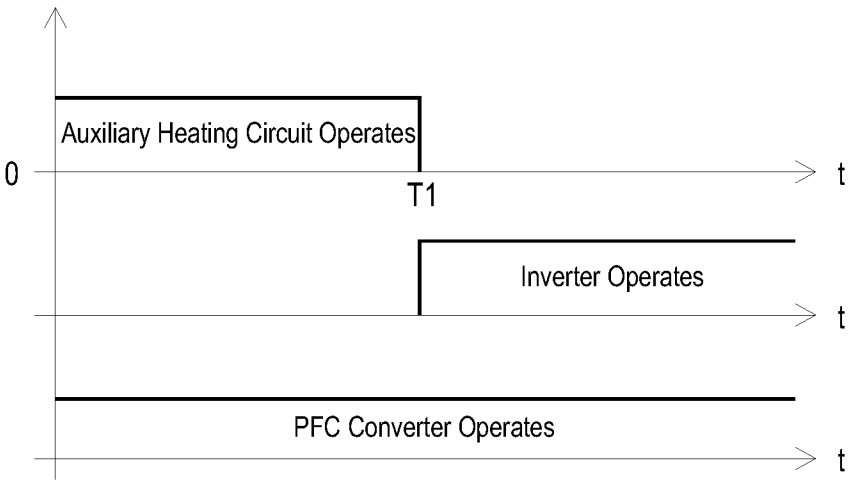
FIG. 6 shows the operating sequence of the auxiliary heating circuit 206 and the inverter 204 which is achieved by using the circuitry of FIG. 5.

FIG. 6 shows the operating sequence of the auxiliary heating circuit 206 and the inverter 204 which is achieved by using the circuitry of FIG. 5. As shown in FIG. 6, when the lamp ballast is powered on, the auxiliary heating circuit 206 will operate immediately and the auxiliary voltage generator 502 of the control circuit 208 will readily establish the auxiliary voltage Vcc, such that the operation of the power factor correction converter 202 is started quickly. Hence, regardless the variation of the AC input voltage Vin, the output bus voltage Vbus of the power factor correction converter 202 is able to be stabilized instantly in order to provide a stable pre-heating voltage to pre-heat the filaments. In addition, the timing controller 504 uses the charging operation of the capacitor C5 to count the time, such that the auxiliary heating circuit 206 is disabled and the inverter 204 is enabled after the filaments of the lamps LP1-LP4 have been heated for a predetermined period of time. It is noteworthy that a delay time of about 100 μs is existed between the stating time of the auxiliary heating circuit 206 and the starting time of the power factor correction converter 202. Nonetheless, this delay time is infinitesimal, and thus the auxiliary heating circuit 206 and the power factor correction converter 202 can be substantially considered to be started simultaneously.

Figure 7:
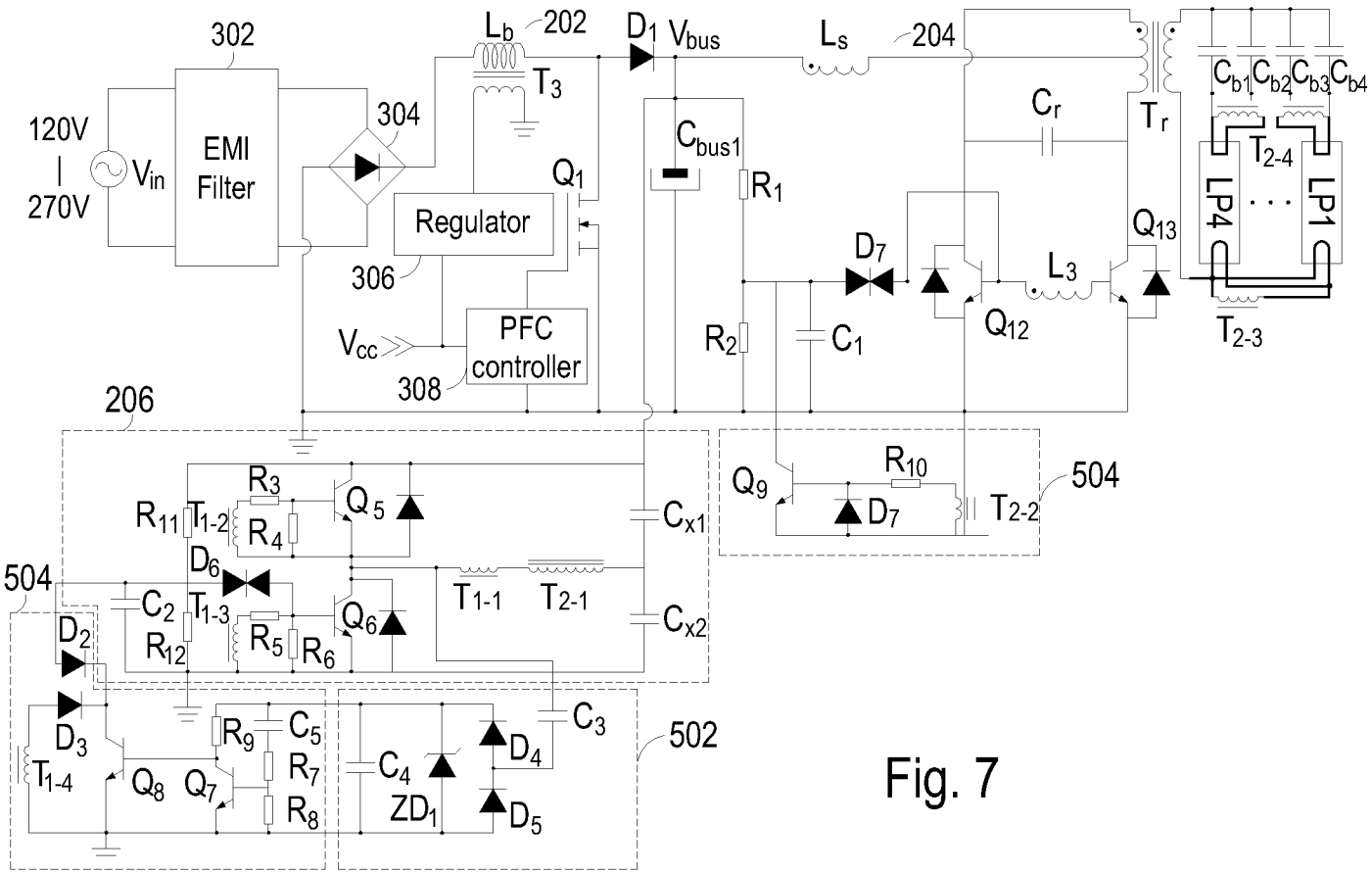
FIG. 7 shows the circuitry of the lamp ballast according to a second embodiment of the invention.

FIG. 7 shows the circuitry of the lamp ballast according to a second embodiment of the invention. Compared to FIG. 5, the inverter of FIG. 7 is a self-oscillating parallel resonant push pull inverter. As shown in FIG. 7, the switches Q12 and Q13 are configured in a push-pull manner, and the winding L3 is connected between the control terminal of the switch Q12 and the control terminal of the switch Q13 for sending synchronous control signals to drive the switches Q12 and Q13. The resonant inductor Ls and the resonant capacitor Cr form a parallel resonant circuit, which is set to generate resonance to transmit the energy of the stable DC bus voltage Vbus outputted by the power factor correction converter 202 to the primary side of the isolated transformer Tr by way of resonance according to the switching of the switches Q12 and Q13. In FIG. 7, the auxiliary heating circuit 206 additionally includes serially-connected capacitors Cx1 and Cx2, which form a resonant circuit for generating resonance to transmit the energy of the stable DC bus voltage Vbus outputted by the power factor correction converter 202 to the primary side of the heating transformer T2-1 by way of resonance according to the switching of the switches Q5 and Q6. In this embodiment, the capacitors Cx1 and Cx2 can be combined into a single capacitor.

Figure 8:
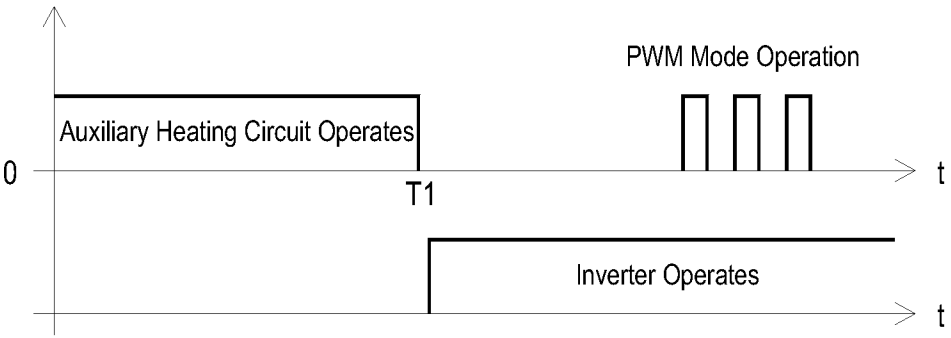
FIG. 8 shows a third sort of the operating sequence of the auxiliary heating circuit 206 and the inverter 204.

FIG. 8 shows a third sort of the operating sequence of the auxiliary heating circuit 206 and the inverter 204. As shown, after the lamp ballast is powered on, the auxiliary heating circuit 206 will operate for a predetermined period of time T1 in order to heat the filaments. Afterwards, the auxiliary heating circuit 206 will stop operating in order to remove the heating power for the filaments for increasing the efficiency. Afterwards, the inverter 204 starts operating to ignite and operate the lamps LP1-LP4. When the lamps LP1-LP4 are operating in the dimming mode, the auxiliary heating circuit 206 will operate in PWM (pulse-width modulation) mode in order to maintain the temperature of the filaments of the lamps LP1-LP4 at a proper value.

Figure 9:
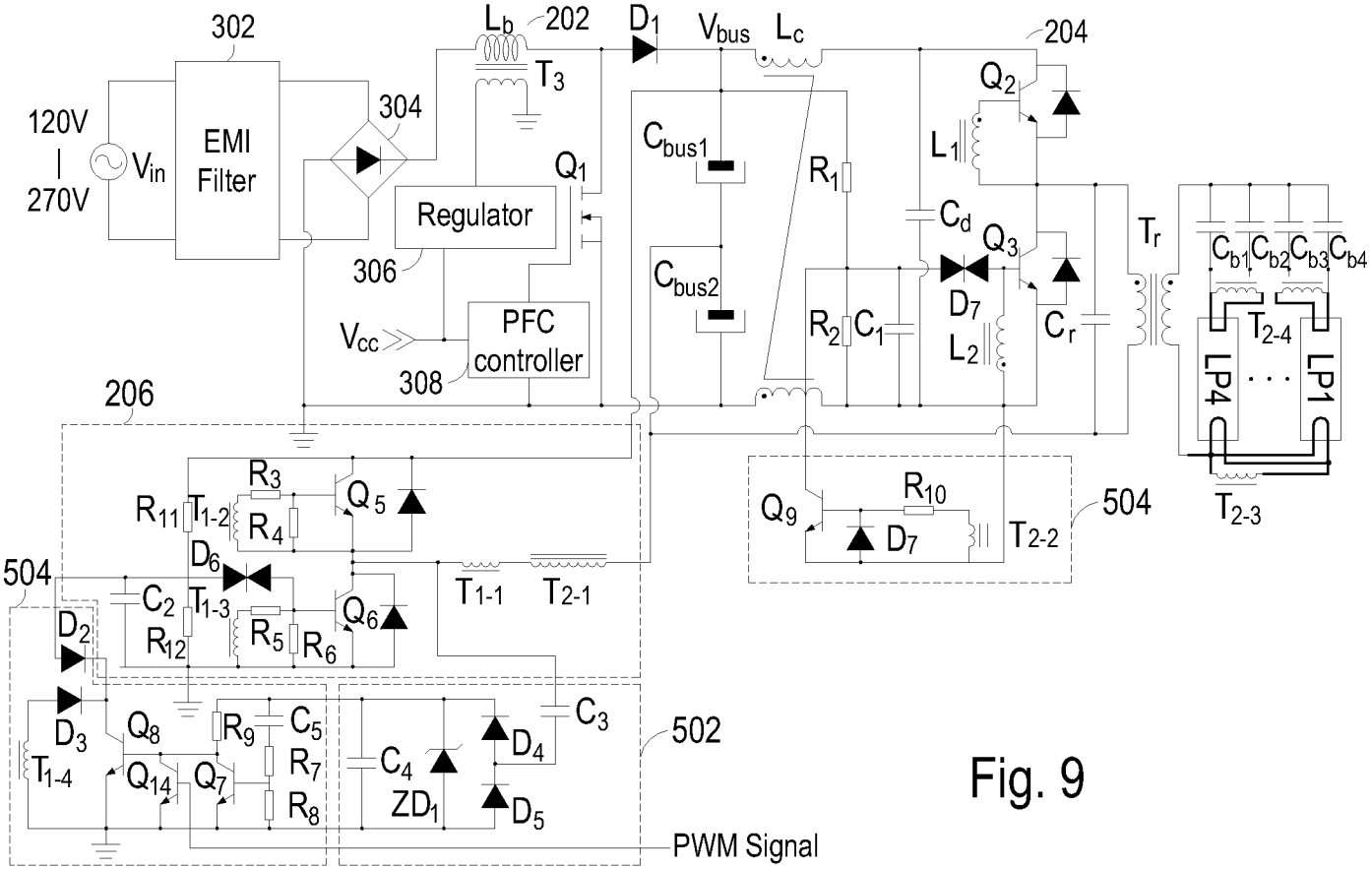
FIG. 9 shows the circuitry of the lamp ballast according to a third embodiment of the invention.

FIG. 9 shows the circuitry of the lamp ballast according to a third embodiment of the invention. The circuitry of FIG. 9 fulfills the operating sequence of the auxiliary heating circuit 206 and the inverter 204 of FIG. 8. Compared to FIG. 5, the timing controller 504 of FIG. 8 additionally includes a PWM switch Q14 which is driven by a PWM signal. Thus, when the lamps LP1-LP4 are operating in the dimming mode, the auxiliary heating circuit 206 is allowed to operate in the PWM mode. The PWM mode is set to allow the lamp power to be lower than 60% of its full power, for example. In this way, the temperature of the filaments of the lamps LP1-LP4 is maintained at a proper value. In this embodiment, the PWM signal can be inputted from outside circuits or can be supplied by a DC dimming signal or a dimmer.

Figure 10:
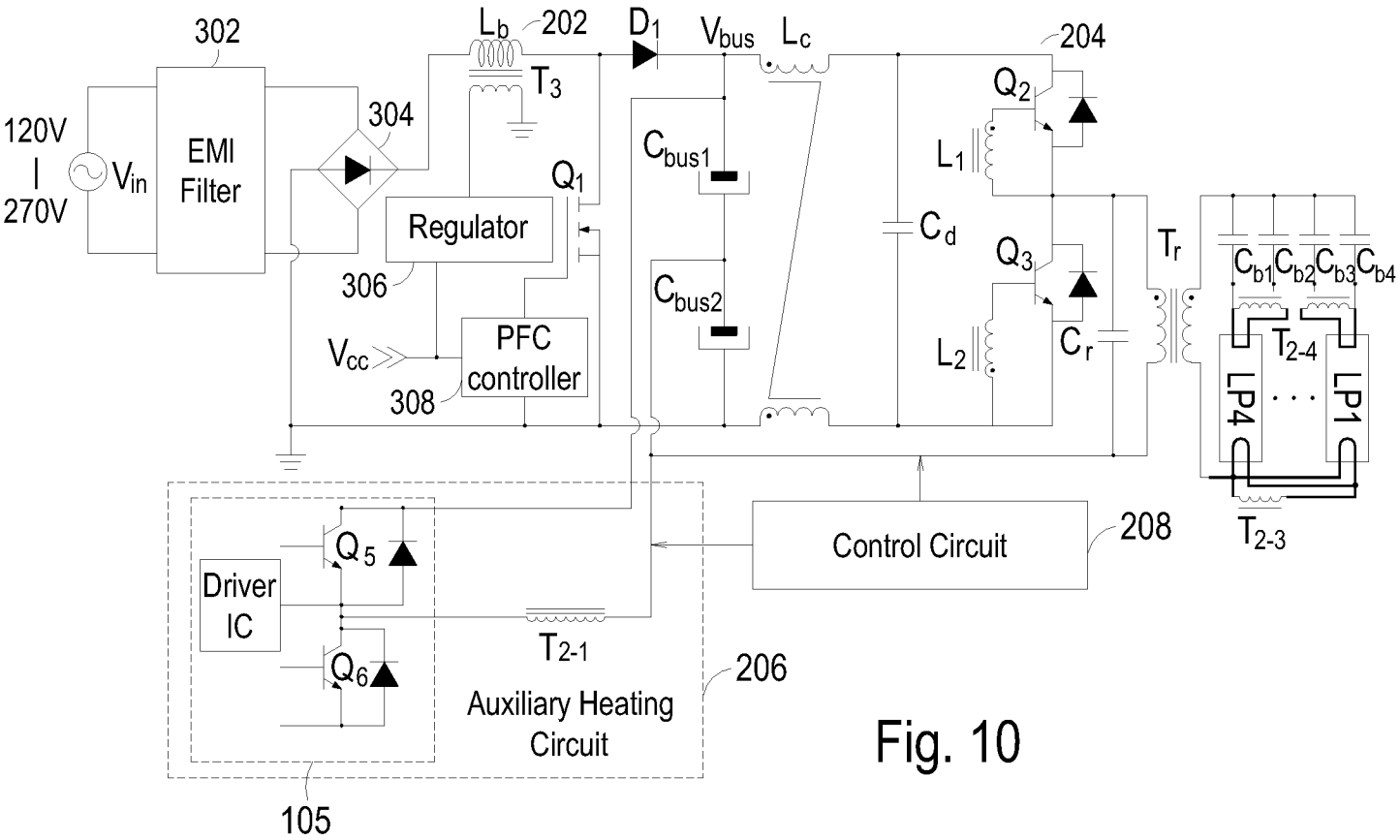
FIG. 10 shows the circuitry of the lamp ballast according to a fourth embodiment of the invention.

FIG. 10 shows the circuitry of the lamp ballast according to a fourth embodiment of the invention. Compared to FIG. 3, the self-oscillating resonant half-bridge converter in the auxiliary heating circuit 206 is implemented in an integrated chip 105, as shown in FIG. 10. Hence, the advantages of the circuitry of FIG. 10 are that the number of elements is reduced and the reliability of the circuitry is enhanced.

Figure 11:
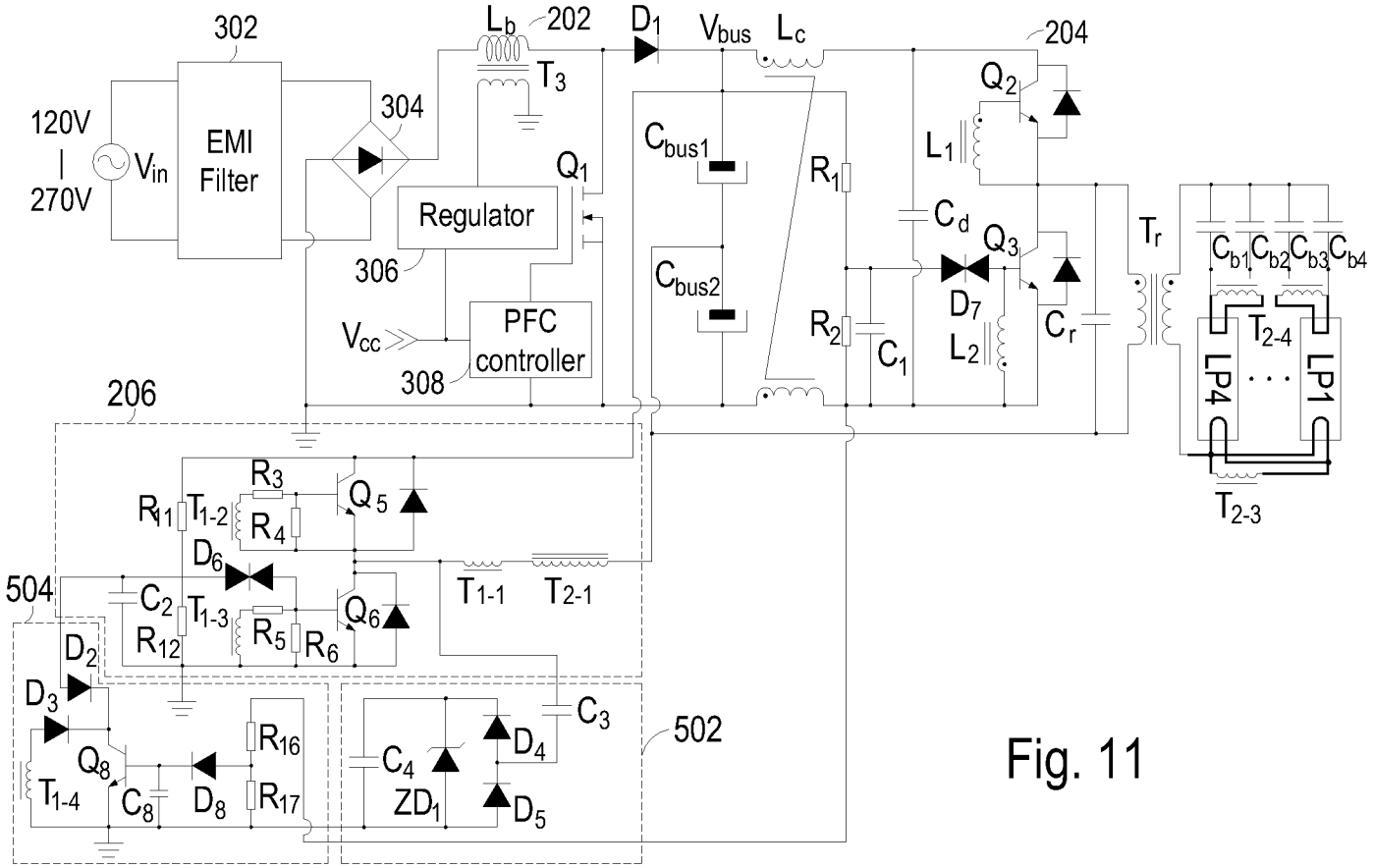
FIG. 11 shows the circuitry of the lamp ballast according to a fifth embodiment of the invention.

FIG. 11 shows the circuitry of the lamp ballast according to a fifth embodiment of the invention. Compared to FIG. 5, the timing controller 504 of FIG. 11 includes the winding T1-4, the control switch Q8, the diodes D2, D3 only, whereas the RC timer consisted of the capacitor C5 and the resistors R7, R8, and R9, the control switches Q7, Q9, Q10, the diode D7, the resistor R10, the winding T2-2 are eliminated from FIG. 11. Also, the circuitry of FIG. 11 additionally includes serially-connected voltage-dividing resistors R16, R17, a capacitor C8, and a diode D8, and the other end of the voltage-dividing resistor R2 of the inverter 204 is connected to the voltage-dividing resistor R16. In this embodiment, the voltage-dividing resistors R1 and R2 and the capacitor C1 form a delay circuit, which is set to allow the inverter 204 to start operating after the output bus of the power factor correction converter 202 has supplied electricity for a predetermined period of time. Thus, the inverter 204 can be started after the auxiliary heating circuit 206 has been operating for a predetermined period of time (which is the delay time offered by the delay circuit). Also, when the inverter 204 has started, the common-mode choke Lc of the inverter 204 will induce a current, thereby establishing a voltage. This voltage is applied to the gate of the control switch Q8 through the voltage-dividing resistors R16, R17 and the diode D8 in order to turn on the control switch Q8, thereby turning off the auxiliary heating circuit 206. Hence, in this embodiment, the auxiliary heating circuit 206 will be started first to pre-heat the filaments of the gas discharge lamps LP1-LP4, and the inverter 204 will be started after a while. After the inverter 204 has been started, the auxiliary heating circuit 206 is turned off then.

Another yet embodiment of the invention is accomplished by providing a method for operating at least one gas discharge lamp. The inventive method includes the following steps. First, the filaments of the lamp are heated for a predetermined period of time. Next, the heating power for heating the filaments of the lamp is removed, and then the inverter of the lamp ballast used to drive the lamp is started. Thus, the lamp is operated.

Another yet embodiment of the invention is accomplished by providing a method for operating at least one gas discharge lamp. The inventive method includes the following steps. First, the filaments of the lamp are heated for a predetermined period of time. Next, the inverter of the lamp ballast used to drive the lamp is started, thereby operating the lamp. Finally, when the lamp is operating in a stable state, the heating power for heating the filaments of the lamp is removed.

In conclusion, the invention provides a lamp ballast having a filament heating apparatus for gas discharge lamps. The inventive lamp ballast includes a power factor correction converter and an inverter, and a filament heating apparatus. The inverter may be a self-oscillating parallel resonant half-bridge converter or a self-oscillating parallel resonant push-pull inverter. The filament heating apparatus is connected to the output end of the power factor correction converter, and is used to stably pre-heat the filaments of gas discharge lamps for a predetermined period of time and then start the inverter to ignite and operate the gas discharge lamps. The filament heating apparatus includes an auxiliary heating circuit and a control circuit, in which the auxiliary heating circuit is made up of a self-oscillating resonant half-bridge converter and a heating transformer for providing the heating power used to pre-heat the filaments of the gas discharge lamps LP1-LP4. The control circuit is set to generate the auxiliary voltage for starting the power factor correction converter and start the inverter to ignite and operate the gas discharge lamps and turn off the auxiliary heating circuit after the auxiliary heating circuit has been operating to pre-heat the filaments of the gas discharge lamps for a predetermined period of time. Or otherwise, when the gas discharge lamps are in the dimming mode, the control circuit restarts the auxiliary heating circuit to allow the auxiliary heating circuit to operate in the PWM mode, thereby maintaining the temperature of the filaments of the gas discharge lamps LP1-LP4 at a proper value. With the invention, the filaments of the gas discharge lamps can be stably pre-heated before the inverter starts, and the heating power for the filaments of the gas discharge lamps can be removed before the inverter starts or after the inverter starts, thereby improving efficiency.

While the invention has been described in terms of what are presently considered to be the most practical and preferred embodiments, it is to be understood that the invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the invention which is defined by the appended claims.

What is claimed is:

1. A lamp ballast, comprising:

a power factor correction converter for receiving an AC input voltage and converting the AC input voltage into a DC bus voltage;

an inverter connected to an output end of the power factor correction converter for converting the DC bus voltage into an AC output voltage for powering at least one gas discharge lamp; and a filament heating apparatus for gas discharge lamp connected to the output end of the power factor correction converter, comprising:

an auxiliary heating circuit connected to the output end of the power factor correction converter for converting the DC bus voltage into a heating power for pre-heating filaments of the at least one gas discharge lamp;

a control circuit connected to the inverter and the auxiliary heating circuit for allowing the auxiliary heating circuit to start, and turning off the auxiliary heating circuit and then starting the inverter, or starting the inverter and then turning off the auxiliary heating circuit after the auxiliary heating circuit has been operating for a predetermined period of time.

2. The lamp ballast according to claim 1 wherein the power factor correction converter is a boost converter.

3. The lamp ballast according to claim 1 wherein the inverter includes a self-oscillating parallel resonant half-bridge converter or a self-oscillating parallel resonant push-pull inverter.

4. The lamp ballast according to claim 1 wherein the power factor correction converter and the auxiliary heating circuit are configured to turn on simultaneously.

5. The lamp ballast according to claim 1 wherein the auxiliary heating circuit includes a self-oscillating resonant half-bridge converter and a heating transformer.

6. The lamp ballast according to claim 5 wherein the self-oscillating resonant half-bridge converter is implemented in a driver integrated circuit.

7. The lamp ballast according to claim 1 wherein the control circuit includes:

an auxiliary voltage generator connected to the auxiliary heating circuit for generating an auxiliary voltage to start the power factor correction converter according to the heating power; and a timing controller connected to the auxiliary voltage generator for allowing the auxiliary heating circuit to operate a predetermined period of time and then sending a first control signal to turn off the auxiliary heating circuit.

8. The lamp ballast according to claim 7 wherein the timing controller is configured to send a second control signal to turn on the inverter.

9. The lamp ballast according to claim 7 wherein the auxiliary heating circuit includes a starter circuit connected to an output end of the power factor correction converter for starting the auxiliary heating circuit according to energy outputted by the power factor correction converter.

10. The lamp ballast according to claim 8 wherein the inverter includes a starter connected to the timing controller for receiving the second control signal to start the inverter.

11. The lamp ballast according to claim 8 wherein when the at least one gas discharge lamp is operating in a dimming mode, the timing controller restarts the auxiliary heating circuit to operate in a pulse-width modulation mode, thereby maintaining a temperature of filaments of the at least one gas discharge lamp at a proper value.

12. The lamp ballast according to claim 11 wherein the timing controller further includes a pulse-width modulation switch for receiving a pulse-width modulation signal, and wherein when the at least one gas discharge lamp is operating in a dimming mode, the auxiliary heating circuit is driven to operate in the pulse-width modulation mode in response to the pulse-width modulation signal.

* * * * *